US008253519B2

(12) United States Patent
Mikl et al.

(10) Patent No.: US 8,253,519 B2
(45) Date of Patent: Aug. 28, 2012

(54) COIL FORMER AND COIL BODY FOR AN ELECTROMAGNETIC RELAY

(75) Inventors: Rudolf Mikl, Arbesthal (AT); Leopold Mader, Mödling (AT)

(73) Assignee: Tyco Electronics Austria GmbH, Vienna (AT)

( * ) Notice: Subject to any disclaimer, the term of this patent is extended or adjusted under 35 U.S.C. 154(b) by 282 days.

(21) Appl. No.: 12/621,919

(22) Filed: Nov. 19, 2009

(65) Prior Publication Data

US 2010/0060396 A1 Mar. 11, 2010

Related U.S. Application Data

(63) Continuation of application No. PCT/EP2008/003769, filed on May 9, 2008.

(30) Foreign Application Priority Data

May 24, 2007 (DE) ..... 10 2007 024 128

(51) Int. Cl.
*H01F 5/00* (2006.01)

(52) U.S. Cl. ..... 335/299; 335/78

(58) Field of Classification Search ..... 20/78; 335/78
See application file for complete search history.

(56) References Cited

U.S. PATENT DOCUMENTS

| | | | | |
|---|---|---|---|---|
| 4,232,281 | A | 11/1980 | Smith | |
| 5,844,456 | A * | 12/1998 | Mader | 335/78 |
| 6,283,745 | B1 * | 9/2001 | Suzuki | 425/441 |
| 6,359,537 | B1 * | 3/2002 | Ichikawa et al. | 335/85 |
| 6,483,407 | B1 * | 11/2002 | Matsuda et al. | 335/78 |
| 2002/0109569 | A1 | 8/2002 | Yamashita et al. | |

FOREIGN PATENT DOCUMENTS

| | | | |
|---|---|---|---|
| CH | 359480 | | 1/1962 |
| DE | 6903063 | | 6/1969 |
| DE | 6907606 | | 11/1969 |
| DE | 19718985 | C1 | 8/1998 |
| EP | 1271593 | A2 | 1/2003 |
| JP | 04-356904 | A | 12/1992 |
| JP | 2001126602 | A | 5/2001 |

OTHER PUBLICATIONS

German Patent Office Action cited in Application No. 102007024128, dated Jan. 30, 2008, 3 pages.
International Preliminary Report on Patentability for co-pending application PCT/EP2008/003769 dated Nov. 24, 2009, 6 pages.
International Search Report and Written Opinion for International Application No. PCT/EP2008/003769; 12 pages.
The First Office Action (translated in English), Application or Patent No. 200880017208.7, Issuing Date: Feb. 16, 2012; 8 pages.

* cited by examiner

*Primary Examiner* — Elvin G Enad
*Assistant Examiner* — Lisa Homza
(74) *Attorney, Agent, or Firm* — Barley Snyder

(57) ABSTRACT

A coil former for an electromagnetic relay is configured to receive a core and a coil winding. The coil former includes a first coil flange, a second coil flange, and a cylindrical winding area for fixing a coil winding arranged between the first and second coil flange, wherein at least one of the coil flanges is shaped such that at least a portion of one coil flange sits flush with the winding area of the coil former in a region of a periphery of the coil former. Also, a coil body for an electromagnetic relay includes a base integrally connected to the coil former. The coil former or the coil body is formed such that, in the production thereof, it has no more than three demolding directions for a master mould.

10 Claims, 4 Drawing Sheets

COIL FORMER AND COIL BODY FOR AN ELECTROMAGNETIC RELAY

CROSS-REFERENCE TO RELATED APPLICATIONS

This application is a continuation of PCT International Application No. PCT/EP2008/003769, filed May 9, 2008, which claims priority under 35 U.S.C. §119 to German Patent Application No. DE 10 2007 024 128.5, filed May 24, 2007.

FIELD OF THE INVENTION

The invention relates an electromagnetic relay and in particular to a coil former and a coil body of an electromagnetic relay.

BACKGROUND

In order to achieve a particularly simple manufacturing process and compact construction in electromagnetic relays, it is known for the base and the coil former of such an electromagnetic relay to be produced from a plastic material in a one piece construction. DE 19718985 C1 shows, for example, a relay having a combined coil body of this type. The relay, disclosed, consists of a coil former, a T-shaped or almost M-shaped core, a U-shaped armature, a card-shaped slider, a fixed contact spring, a mobile contact spring, a casing and two coil terminals fixed in the coil former. The double plate which comprises receiving slots for the connector elements of the contact springs is integrally molded on the coil former.

A further known configuration of a relay with a coil body of this type is known from EP 1 271593 A2. There is a decisive drawback, however, with this known configuration during production. That is to say, generally by means of an injection-molding process, it is always necessary to have four demolding directions. This is based on the fact that the known coil bodies correspondingly include many undercuts. Of course, this also applies to known coil formers, which are produced separately without the base. In addition, the required master mold tools for producing such a coil former or coil body are comparatively expensive, and the production method is correspondingly lengthy, in particular with regard to demolding process.

Combined coil bodies generally include a base and a coil former which are produced in one piece and of which the longitudinal axes extend substantially transversely to one another. The flanges required for fixing the coil winding are conventionally produced, on the one hand, in an end region of the coil former and, on the other hand, are formed so as to be integrated by a corresponding face of the base (see, for example, FIG. 14 of EP 1 271 593). In contrast, a single piece construction including a base and a coil former produced integrally would provide low production and assembly costs, as well as high mechanical strength.

SUMMARY

An object of the present invention, among others, is to improve a coil former for an electromagnetic relay so the coil body can be produced more quickly and in a more cost-effective manner.

The coil former for an electromagnetic relay includes a first coil flange, a second coil flange, and a cylindrical winding area for fixing a coil winding. The cylindrical winding area is arranged between the first and second coil flange. At least one of the coil flanges is shaped such that at least a portion of one coil flange is flush with the winding area of the coil former in a region of a periphery of the coil former.

BRIEF DESCRIPTION OF THE DRAWINGS

The present invention will be described in detail in the following based on the figures enclosed with the application, of which.

DETAILED DESCRIPTION OF THE EMBODIMENT(S)

For an improved understanding of the invention, it will now be described in more detail with the aid of the embodiments shown in the following figures.

Figure 1:
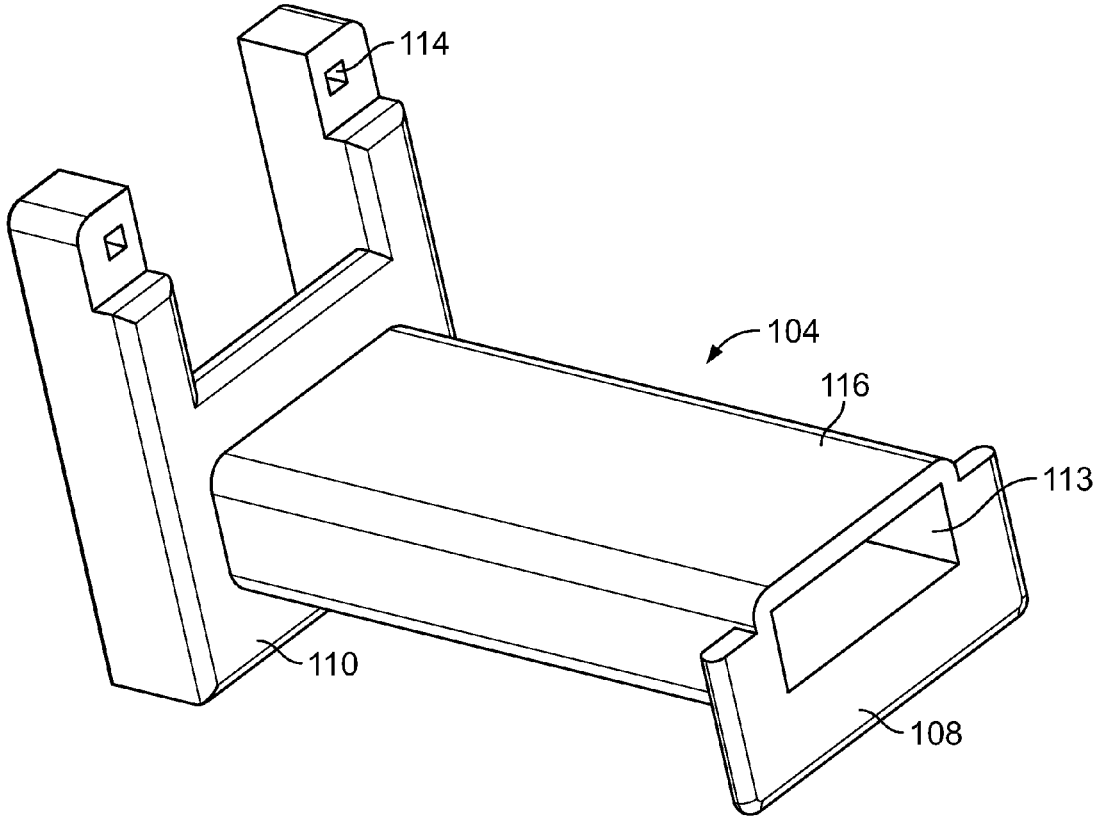
FIG. 1 is a perspective view of a coil former according to the invention.
Figure 2:
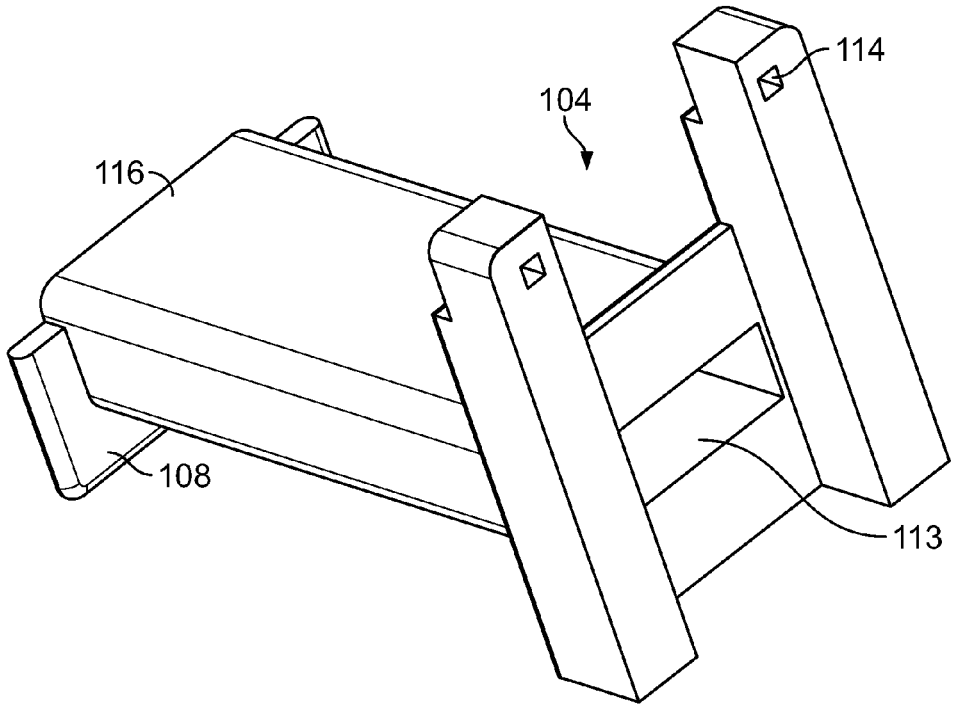
FIG. 2 is a perspective view of the coil former shown in FIG. 1 rotated by 180 degrees.

With reference to FIGS. 1 and 2, a coil former 104 is shown as a substantially rectangular coil tube having a first coil flange 108 and a second coil flange 110, between which a cylindrical winding area 116 for a coil winding 124 (see FIG. 6) is arranged. In an interior 113 of the coil former 104, a substantially u-shaped core 126 (see FIG. 6) may be arranged as shown, for example, in FIG. 6.

In the embodiment shown, the first coil flange 108 does not occupy the entire periphery of the winding area 116. Rather, the first coil flange 108, according to the invention, is arranged along three peripheral sides of the winding area 116, and is omitted from the fourth side of a rectangular cross-section thereof. Because the first coil flange 108 is flush with the winding area 116 along the fourth side of a rectangular cross-section, an outer side of the coil former 104 may be demolded at this face in the same direction as the interior 113. In this embodiment, the second coil flange 110 is integrated with a base 106 (see FIG. 6), through which coil terminals 115 (see FIG. 6) are guided through openings 114.

In particular, the construction of the coil former 104, according to the invention, has a particularly advantageous effect with regard to injection molding, which is characterized in that plasticized material, such as a thermoplastic polymer, is injected into a cooled master mold tool (the injection-molding tool) at a high pressure. In the case of thermosets, the plasticized material is injected into a heated master mold tool at a high pressure and solidifies under the influence of pressure. After the plasticized material has solidified, the injection-molding tool is opened and the molded part is removed. Opening the injection-molding tool is a multiple-stage process, of which the complexity depends on the number of undercuts in the molding. In the embodiment shown, the coil former is prepared from an electrically insulating material, and manufactured using injection molding. However, other plasticized materials and manufacturing methods are possible, as long as a portion of the coil former 104 is prepared having a first coil flange 108 that is flush with the winding area 116. Therefore, the production method allows for the outer side of the coil former 104 to be demolded along this face in the same direction as the interior 113.

Figure 3:
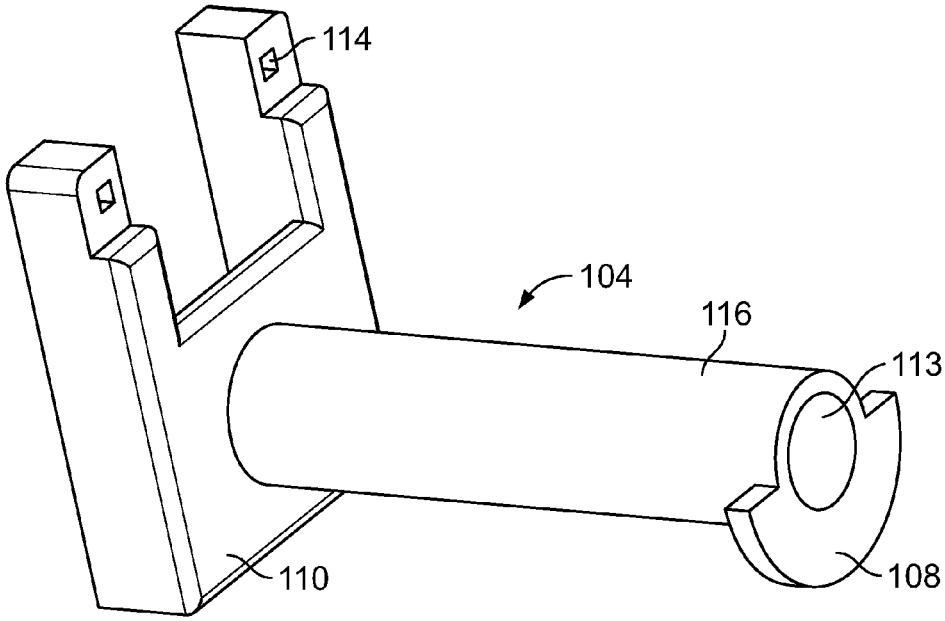
FIG. 3 is a perspective view of a coil former according to another embodiment of the invention.
Figure 4:
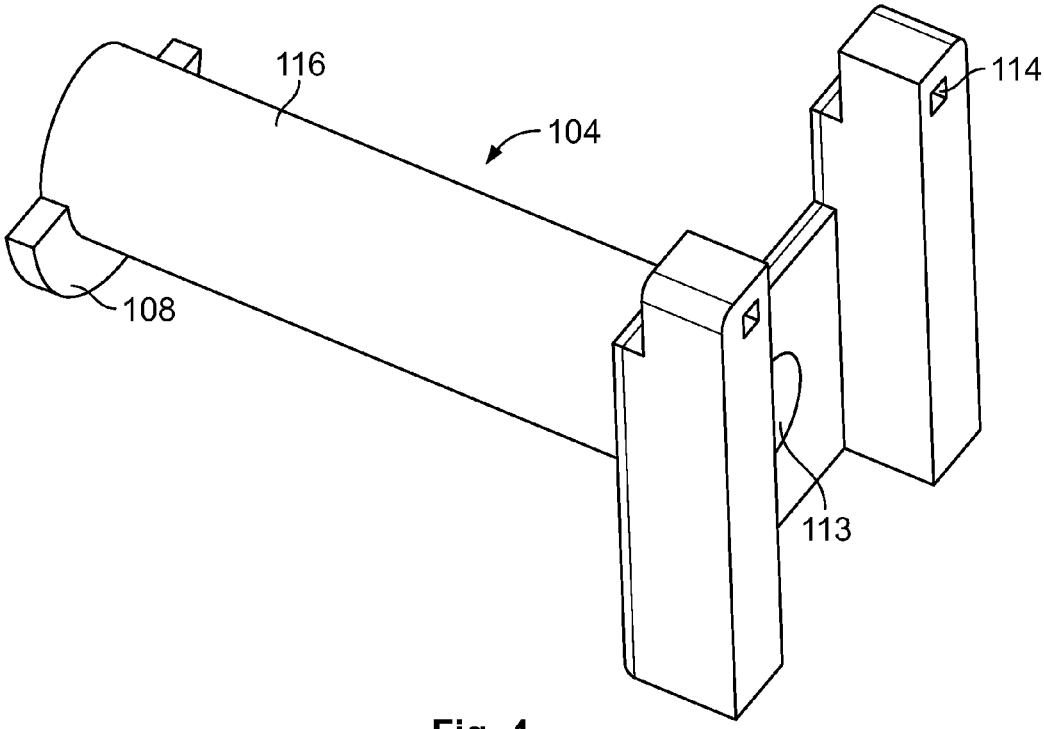
FIG. 4 is a perspective view of the coil former shown in FIG. 3 rotated by 180 degrees.

FIGS. 3 and 4 illustrate another embodiment of the coil former 104, according to the invention, which includes the second coil flange 110 substantially unchanged. Although cylindrical, the winding area 116 has a circular cross-section. In order to achieve the same effect in demolding the coil former 104 in FIGS. 1 and 2, the first coil flange 108 is prepared as a semi-circular collar in an end region of the winding area 116.

Figure 6:
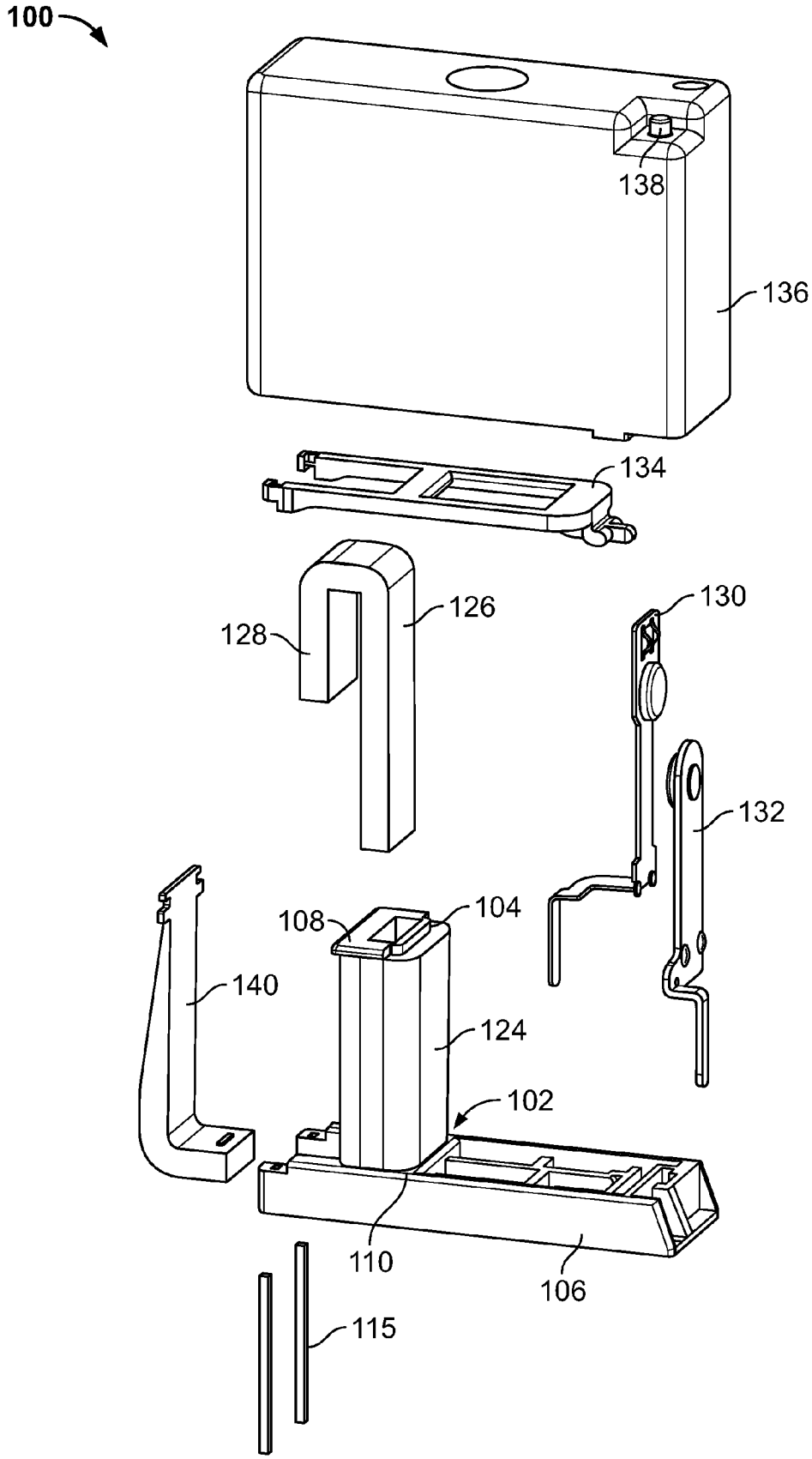
FIG. 6 is an exploded perspective view of an electromagnetic relay with the coil body according to the invention.

In principle, the first coil flange 108 may not necessarily be provided with the coil former 104, in order to reliably fix and hold the coil winding 124 (see FIG. 6). Rather, in order to save material, further gaps may be provided so only one type of collar plate adopts the function of the first coil flange 108. The main advantage of the configuration of the coil former 104, according to the invention, is that it is easy to produce.

Figure 5:
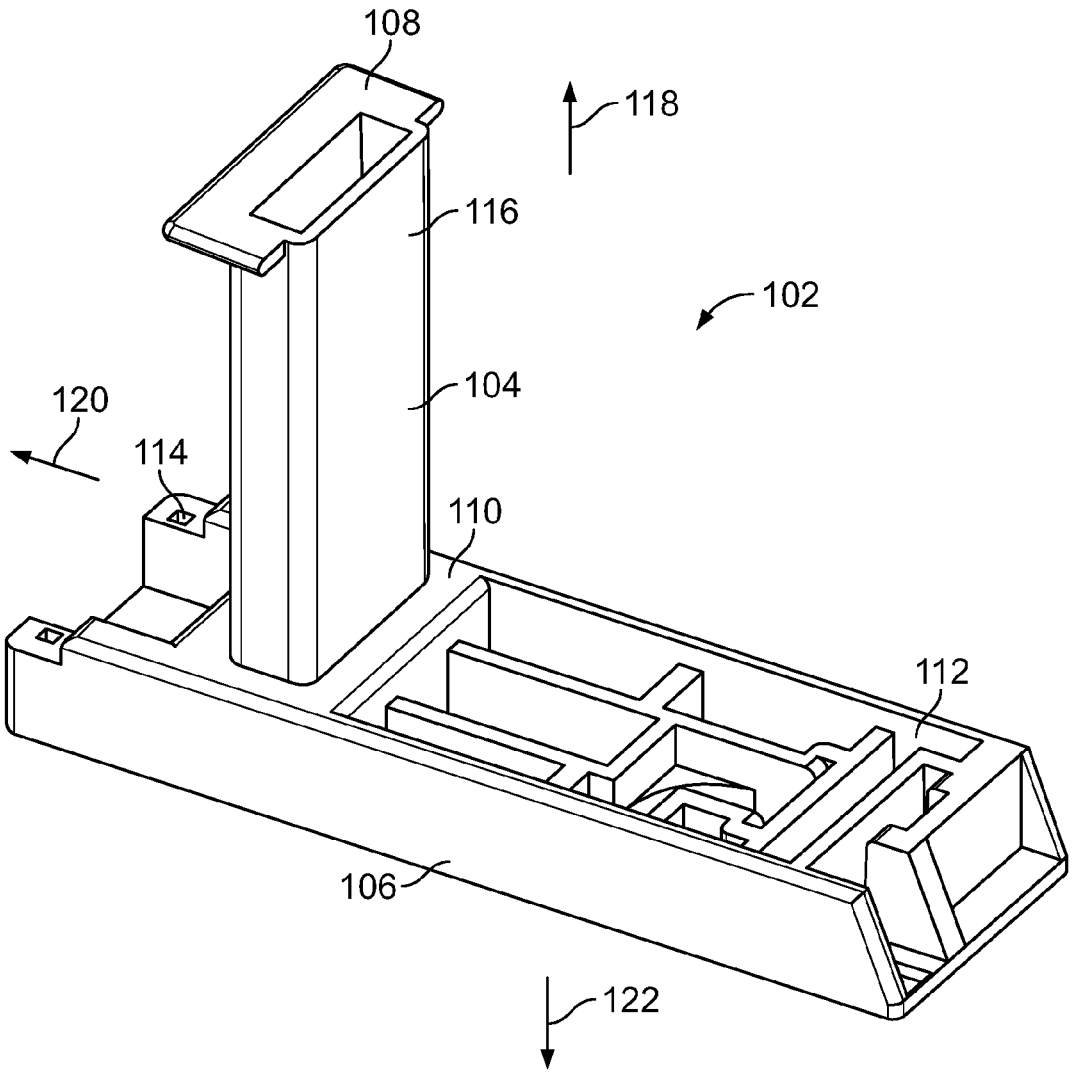
FIG. 5 is a perspective view of a coil body for an electromagnetic relay, according to the invention.

With reference to FIG. 5, an integrated coil body 102 is explained in greater detail. The coil body 102, according to the invention, combines, in an integrated construction, a coil former 104 and a base 106, which functions as a base for an electromagnetic relay 100 (see FIG. 6). The coil former 104 and the base 106 are integrally connected to one another and are prepared from an electrically insulating material using, for instance, injection-molding techniques. The coil former 104, according to the invention, is configured as a cylindrical hollow body. Furthermore, in the embodiment shown, the coil former 104 has a rectangular inner cross-section, which corresponds to a cross-section of the core 126 (see FIG. 6).

At a free end of the coil former 104 a collar is arranged so as to form a first coil flange 108. A second coil flange 110 is produced by a corresponding flange region of the base 106, i.e. a surface portion of the base 106. Accordingly, a longitudinal axis of the coil former 104 corresponds to a winding coil axis and extends substantially transversely to a longitudinal axis of the base 106.

Receiving slots 112, for inserting contact springs, of a contact system are provided in the base 106. Openings 114 are formed in the second coil flange 110 and are used for fixing coil terminals 115, i.e. coil connector pins (see FIG. 6).

According to the invention, the first coil flange 108, between which the coil winding 124 (see FIG. 6), is fixed, is not integrally molded circumferentially at an end region of the coil former 104. Only a region facing the openings 114 of the coil former cross-section and a part of the respective shorter sides, extending transversely thereto of the rectangular cross-section, is provided with the first coil flange 108.

The first coil flange 108, formed as a partial flange, is adequate for securely fixing and holding the coil winding 124 (see FIG. 6). However, on the other hand, the first coil flange 108 also allows the winding area 116 facing the base 106 with the receiving slots 112 to be configured, so as to be flush and with no undercutting collar. As can be seen in FIG. 5 and as is shown by arrows 118, 120 and 122, this constructive measure means that, during production, the coil body 102, which has been cured, can be demolded by removal of a master mould in three demolding directions.

According to the invention, the first coil flange 108, minimized in such a way that the fourth side of the cross-section, along a periphery of the winding area 116, remains free, allows the coil body 102 to be demolded in a substantially simplified manner. Furthermore, the production of the coil body 102 is simplified, and allows for a simplified tool. In particular, the coil body 102, of this type, may be advantageously used in the particular field of electromagnetic relays.

The invention is therefore based on the idea that one of the two coil flanges 108, 110 of the coil former 104 are configured in such a way that a portion of one coil flange (i.e. the first coil flange 108), specifically the periphery, sits flush with the winding area 116. An omission of this portion of one of the two coil flanges 108, 110 allows the outer side of the coil former 104 to be demolded in the same direction as the core 126. In this manner, it is possible to construct undercuts of a coil former 104, in such a way, that a minimum number of demolding directions may be provided, even only two in an appropriate construction. This reduces the complexity of the master mold and accelerates demolding during the production process. For an integrated coil body 102, which has such a coil former 104 with an integral base 106, reduction of necessary demolding directions may be performed in an advantageous manner according to the invention.

As shown in FIG. 6, the electromagnetic relay 100 includes the coil body 102, which integrally combines the coil former 104 and the base 106, according to the invention. The coil winding 124 is fixed and securely held between the first coil flange 108 and the second coil flange 110 of the base 106, which is configured as the second coil flange 110.

The core 126 is inserted into the coil former 104 and arranged in such a way that a yoke 128 can cooperate with an armature 140. The coil winding 124 is supplied with current via the coil terminals 115. A fixed contact 132 and a moveable contact 130 are arranged in the receiving slots 112 (see FIG. 5).

When the current flows, the armature 140 is attracted to the yoke 128 and the moveable contact spring 130 is pressed onto the fixed contact 132 via a slider 134, which may occasionally also be referred to as a ridge, and electrical contact is produced.

A casing 136 protects the electromagnetic relay 100 from dust and disruptive environmental influences. However, by removing a protruding lug 138, the relay may be ventilated if desired.

According to another embodiment of the present invention, the coil former 104, with only two demolding directions, may be produced in that one of two coil flanges 108, 110 may be integrally molded on an end region of the coil former 104 does not occupy the entire periphery, but is only present at approximately less than three quarters of the periphery. A part of the periphery of the coil former 104, facing the region of the base 106, in which part the contacts 130, 132 are arranged, is configured without an undercut so no coil flange is provided there. In this manner, the master mold can be removed from the finished coil former 104 in only two demolding directions.

The present invention is therefore based on the idea that in order to reliably fix and hold the coil winding 124, it is not necessary for the first coil flange 108 to be circumferential. This basic principle may of course also be used for any type of coil which includes a coil former 104 with a coil winding 124 wound thereupon.

While the embodiments of the present invention have been illustrated in detail, it should be apparent that modifications and adaptations to those embodiments may occur. The scope of the invention is therefore limited only by the following claims.

The invention claimed is:

1. A coil former for an electromagnetic relay, comprising:

a first coil flange;

a second coil flange; and a winding area having a hollow cylindrical shape with a rectangular crosssection and being arranged between the first and second coil flange for fixing a coil;

wherein at least one of the coil flanges is shaped such that at least a portion thereof is flush with the winding area and the first coil flange is arranged on only three sides of the rectangular crosssection with no undercuts on the fourth side, so that said coil former has only two demolding directions for a master mold during a production process.

2. The coil former according to claim 1, wherein the first coil flange of the coil former is formed by a collar which occupies less than 75% of a periphery of the winding area.

3. The coil former according to claim 2, wherein the coil former is configured as a cylindrical hollow body.

4. The coil former according to claim 3, wherein the coil former includes an interior corresponding to a cross-section of a yoke.

5. The coil former according to claim 1, wherein the coil former includes an interior corresponding to a cross-section of a yoke.

6. The coil former according to claim 1, wherein the coil former is prepared from electrically insulating material using injection-molding.

7. A coil former for an electromagnetic relay, comprising:

a first coil flange;

a second coil flange; and a winding area having a hollow cylindrical shape with a circular crosssection and being arranged between the first and second coil flange for fixing a coil;

wherein at least one of the coil flanges is shaped such that at least a portion thereof is flush with the winding area and the first coil flange is arranged in a semicircular region of the crosssection, so that said coil former has only two demolding directions for a master mold during a production process.

8. The coil former according to claim 7, wherein the first coil flange of the coil former is formed by a collar which occupies less than 75% of a periphery of the winding area.

9. The coil former according to claim 8, wherein the coil former includes an interior corresponding to a cross-section of a yoke.

10. The coil former according to claim 8, wherein the coil former is prepared from electrically insulating material using injection-molding.

* * * * *